US005823384A

United States Patent [19]

Sartori de Zamparolo

[11] Patent Number: 5,823,384

[45] Date of Patent: Oct. 20, 1998

[54] DRINKING INSERT FOR CANS CONTAINING BEVERAGES

[76] Inventor: Carmen Maria Sartori de Zamparolo, Malaver 1946 piso 2° Florida, (1642) Buenos Aires, Argentina

[21] Appl. No.: 967,507

[22] Filed: Nov. 11, 1997

[30] Foreign Application Priority Data

Jan. 23, 1997 [AR] Argentina ..... M97 01 00286

[51] Int. Cl.[6] ..... B65D 25/48

[52] U.S. Cl. ..... 220/717; 220/718

[58] Field of Search ..... 220/716, 717, 220/718

[56] References Cited

U.S. PATENT DOCUMENTS

| | | | |
|---|---|---|---|
| 1,161,730 | 11/1915 | Reynolds | 220/717 |
| 1,191,464 | 7/1916 | Record | 220/717 |
| 1,459,311 | 6/1923 | Ozlek | 220/717 |
| 1,975,546 | 10/1934 | Enman | 220/718 |
| 2,203,476 | 6/1940 | Trabold | 220/717 |
| 3,429,478 | 2/1969 | Ward | 220/717 |

*Primary Examiner*—Joseph M. Moy
*Attorney, Agent, or Firm*—Bachman & LaPointe

[57] ABSTRACT

The driking insert of the invention comprises a flexible, disposable laminar body made of a non toxic and recyclable plastic material. It may be molded or stamped. It has an oval shape with a specially shaped, symmetrical and excentric groove, through which a can containing beverage is inserted, being fitted around its edge. Further, the laminar body is curved, forming a semicylindrical channel having rounded contour, collecting the liquid in order to facilitate drinking.

3 Claims, 1 Drawing Sheet

DRINKING INSERT FOR CANS CONTAINING BEVERAGES

FIELD OF THE INVENTION

The instant invention relates to a drinking insert for cans containing beverages, affording a new type of disposable device to be applied to said cans, through which beverages contained in the cans may be consumed directly from the container.

Another object of the instant invention is a device which may be made of a non toxic and recyclable material, which is applied under pressure into the neck of the aluminium can to which it is tightly adapted, wherein the can is of the cylindrical type with a stamped cover which may be released by a ring, of the known type for containing any kind of beverages, alcoholic or not, such as soft drinks, juices, beer and the like.

BACKGROUND OF THE INVENTION—PRIOR ART

Usually, the stamped cover at the upper surface of the container is removed, also removing the ring riveted at the center of the upper face with the aluminium portion cut through the less resistant stamped line, and then driking the contents, this being not hygienic or confortable.

Further, some devices are known for drinking the contents of these cans, such as carton or plastic tubes.

Another known device is a frusto-conical hollow body which at the larger diameter portion ends in a semi-spherical cap which could be adapted under pressure on the already open can mouth, such that the contents flow when the can is turned over the cap and may be drunk through the mouth of this kind of funnel.

It is obvious that these embodiments do not advantageously replace a glass, with which some of the beverages expended in this kind of containers, for example beer, taste better.

SUMMARY OF THE INVENTION

The instant invention relates to a drinking insert to be applied to beverage cans which constitutes a simple, economic, non toxic, disposable and recyclable device to allow driking the contents of the can under optimum conditions. The insert is characterized by comprising a flexible laminar body with oval contour defined by circle arcs of different diameter, which are joined as per its excentric larger axis, such that at one side thereof, the semi-circular perimetral contour has, mating with the smaller axis of the laminar body, a projecting tab, substantially triangular and having a rounded vertex. At a short distance of the perimeter there is an opening defined by a concentrical semi-circular line with respect to the adjacent perimetral portion, extending until it joins another opposite line of straight contour mating with the larger axis, wherein the cut is made with a small diameter semicircular shape at the extreme joining points; the portion opposite to said longer axis of the larger surface of the oval laminar body has a radius smaller than the former one and is flattened through a short portion parallel to the larger axis.

A preferred embodiment of the invention will be hereinbelow described, in connection with the accompanying drawings, merely as a non-limiting example thereof. It is to be understood that the forming elements may be replaced by equivalents thereof, without departing from the scope of the instant invention.

BRIEF DESCRIPTION OF THE DRAWINGS

The same reference numbers indicate the same or equivalent parts.

DETAILED DESCRIPTION OF THE INVENTION

Figure 1:
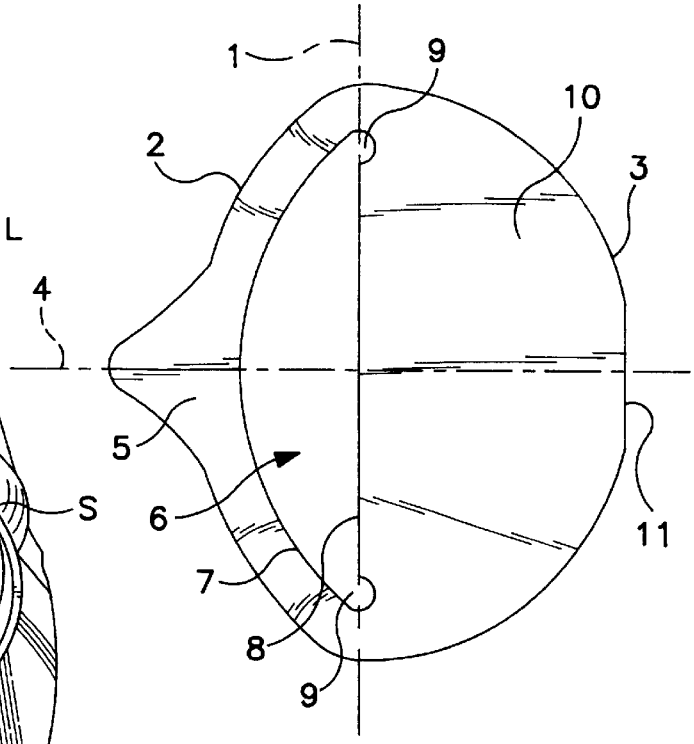
FIG. 1 is a plan view of the insert of the invention.

FIG. 1 shows the insert ready to be used. It may be made by molding or stamping of a non toxi thermoplastic material such as rigid PVC.

It comprises an oval flexible laminar body, derived from an asymmetrical contour as per its larger axis 1, whose body is defined by circle arcs of different diameter, at a side of said larger axis 2 limiting the smaller surface body portion, whose radius is larger than that of the larger surface opposite side 3.

Mating with the smaller axis 4 of the laminar body, a tab 5 projects from contour 2, the tab having a substantially triangular shape with slightly curved legs and rounded vertex.

At a short distance of the perimetral contour 2 there is an opening 6 defined by a line 7 semicircular and concentric with the adjacent perimetral portion, extending until it joins another opposite straight line 8 mating with said larger axis 1.

At the extreme joining points, the cut has a small diameter semicircular shape 9.

The portion opposite to the larger surface oval laminar body 10 has a flattened portion, as per a chord 11 parallel to the larger axis of the flat figure.

The center of the circular arch 3 of laminar body larger surface portion 10 is located at the excentric larger axis 1, while the center of both concentric circular cuts 2 and 7 limiting the opening 6 as well as said laminar body, is located on the smaller axis inside the figure of the laminar body and at a certain distance of its perimetral edge.

Figure 3:
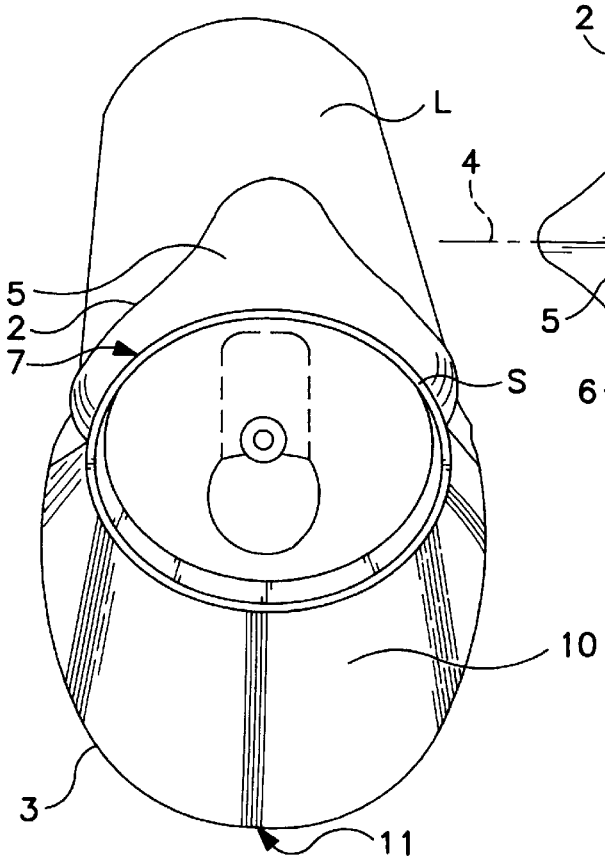
FIG. 3 is another perspective view of the assembly prepared for drinking the contents of the can.
Figure 2:
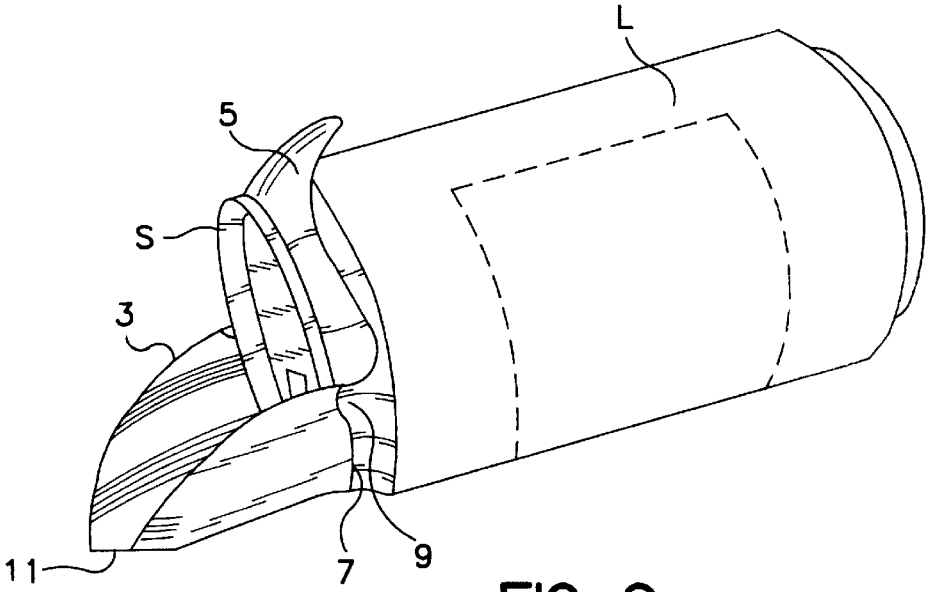
FIG. 2 is a side elevational view of the insert applied to a can, ready for use.

FIGS. 2 and 3 show a can L to which the insert of the invention has been applied. This insert is applied overpassing rim S of can L.

As shown in FIGS. 2 and 3, the laminar body of the instant invention is applied on the upper rim S of can L the inner contour 8 of opening 6 fitting outside this projecting rim, and also the semicircular openings of small diameter 9 fitting precisely at this rim S.

Then, tab 5 is taken and pulled towards the container basis L until edge 7 of opening 6 projects outside rim S and fits into the flange thereof, which is the same occurring with the edge of the semicircular small diameter openings 9 fitted into said rim S, while edge 8 surrounds said rim S.

The larger portion 10 forms, upon flexing, a channel guiding the liquid as it were a glass, while the straight portion 11 of the laminar body, once the insert is curved, offers a shape similar to the edge contour of a conventional glass.

Thus, a preferred embodiment of the instant invention has been described to which those skilled in the art may introduce any modifications which are to be considered within the spirit and scope of the annexed claims.

I claim:

1. Drinking insert for cans containing beverages, of the kind intended for drinking the contents of the can directly and for being disposed after use, characterized by comprising a flexible laminar body with oval contour defined by circle arcs of different diameter, asymmetrical as per its excentric larger axis, such that at one side thereof the semi-circular permietral contour has, mating with the smaller axis of the laminar body, a substantially triangular projecting tab, at a short distance from the perimeter there being an opening defined by a concentrical semicircular line with respect to the adjacent perimetral portion, extending until it joins another opposite line of straight contour mating with the larger axis, wherein the cut is made with a small diameter semicircular shape at the extreme joining points; the portion opposite to said longer axis of the larger surface of the oval laminar body having a radius smaller than the former one and is flattened through a chord parallel to the larger axis.

2. A drinking insert as claimed in claim 1, wherein said larger surface portion has the center of the semicircular arc defining its perimeter located on said excentric larger axis.

3. A drinking insert as claimed in claim 1, wherein the line corresponding to the semicircular cut of the opening and the concentric perimeter of the laminar body have their center located on the smaller axis inside said body.

* * * * *